US008390979B2

(12) United States Patent
Hurley et al.

(10) Patent No.: US 8,390,979 B2
(45) Date of Patent: Mar. 5, 2013

(54) METHOD AND SYSTEM FOR COMMUNICATING AND CONTROLLING ELECTRIC DETONATORS

(75) Inventors: Eldon K. Hurley, Salt Lake City, UT (US); Cornelis L. Kome, Salt Lake City, UT (US); Robert W. Levan, Salt Lake City, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 108 days.

(21) Appl. No.: 13/121,879

(22) PCT Filed: Sep. 29, 2009

(86) PCT No.: PCT/US2009/058778

§ 371 (c)(1),
(2), (4) Date: Jun. 10, 2011

(87) PCT Pub. No.: WO2010/039704

PCT Pub. Date: Apr. 8, 2010

(65) Prior Publication Data

US 2011/0247517 A1 Oct. 13, 2011

Related U.S. Application Data

(60) Provisional application No. 61/101,429, filed on Sep. 30, 2008.

(51) Int. Cl.
*F23Q 7/02* (2006.01)

(52) U.S. Cl. ..... 361/232; 102/217

(58) Field of Classification Search ..... 361/232; 102/214, 215, 217

See application file for complete search history.

(56) References Cited

U.S. PATENT DOCUMENTS

| | | | | |
|---|---|---|---|---|
| 4,674,047 | A * | 6/1987 | Tyler et al. | 89/28.05 |
| 5,214,236 | A | 5/1993 | Murphy et al. | |
| 7,958,824 | B2 * | 6/2011 | Stewart | 102/301 |
| 2003/0159609 | A1 | 8/2003 | Rauscher, Jr. | |
| 2006/0086277 | A1 | 4/2006 | Bossarte et al. | |
| 2010/0275799 | A1 * | 11/2010 | Hummel et al. | 102/217 |

FOREIGN PATENT DOCUMENTS

| | | | |
|---|---|---|---|
| WO | 2005071348 | A1 | 8/2005 |
| WO | 2007143759 | A1 | 12/2007 |
| WO | 2008094060 | A2 | 8/2008 |

OTHER PUBLICATIONS

PCT International Search Report and Written Opinion for International Application No. PCT/2009/058778; International Filing Date: Sep. 29, 2009; 16 pgs.

Chile Office Action for Chilean Patent Application No. 1909-2009; Dated: Sep. 28, 2009; with English Examination Report from Foreign Agent; 10 pgs.

* cited by examiner

*Primary Examiner* — Danny Nguyen
(74) *Attorney, Agent, or Firm* — Cantor Colburn LLP

(57) ABSTRACT

A blasting control system includes a detonator module, and a blasting machine interface configured for serial communication between a blasting machine and the detonator module. The detonator module includes a detonator, a unique electronic ID, a switch configured to enable/disable the detonator in response to verification of the unique electronic ID, a communication device configured for communication with the blasting machine interface, and a processor responsive to instructions from the communication device. The blasting machine interface includes an I/O device, a communication device, and a processor responsive to the I/O device and the communication device. Upon verification of the unique electronic ID via communication from a user via the blasting machine interface, a state of the switch associated with the detonator is placed in an unlocked mode so as to enable activation of the associated detonator upon a fire signal from the blasting machine via the blasting machine interface.

11 Claims, 4 Drawing Sheets

METHOD AND SYSTEM FOR COMMUNICATING AND CONTROLLING ELECTRIC DETONATORS

BACKGROUND OF THE INVENTION

The present disclosure relates generally to electric detonators, particularly to digitally secured electric detonators, and more particularly to the communication and control of digitally secured electric detonators.

Detonator systems have applications in the mining, quarry, construction, pipeline and geophysical exploration industries, where many detonators may be connected and controlled by a single blasting machine. In view of the hazards inherent in such explosive systems, there is a need in the art for improved control and communication between a blasting machine and its associated detonators.

BRIEF DESCRIPTION OF THE INVENTION

An embodiment of the invention includes a blasting control system for use with a blasting machine. The control system includes a detonator module, and a blasting machine interface configured for serial communication between the blasting machine interface and the detonator module. The detonator module includes a detonator, non volatile memory in which to store a unique electronic identification (ID) number, a switching device configured to enable or disable functioning of the detonator in response to the user's input, a communication device configured for communication with the blasting machine interface, and a processor responsive to instructions from the communication device. The blasting machine interface includes an input/output (I/O) device, a communication device, and a processor responsive to the I/O device and the communication device. Upon verification of the unique electronic ID of the detonator module via communication from a user via the blasting machine interface, a state of the switch associated with the detonator is placed in an unlocked mode so as to enable activation of the associated detonator upon a fire signal from the blasting machine via the blasting machine interface.

Another embodiment of the invention includes a method for controlling a blasting system. A detonator module is provided with a detonator in a locked state. A unique identification is provided or stored at and associated with the detonator, verification of the unique identification being operational for unlocking the detonator for controlled detonation. A password is entered into a blasting machine interface for providing operational control of the blasting machine interface. An enable signal is sent from the blasting machine interface to the detonator module, the enable signal containing verification information relating to the unique identification, and the detonator is unlocked at the detonator module upon receipt of the enable signal. A fire signal is sent from a blasting machine to the detonator module via the blasting machine interface, and the detonator is fired upon receipt of the firing signal.

Another embodiment of the invention includes a blasting control system as set forth above having a first processor at the blasting machine interface and a second processor at the detonator. Each of the first and second processors are separately responsive to computer-executable code which when executed on the respective processor facilitates the method as set forth above.

Another embodiment of the invention includes a product having any feature described herein, explicitly or equivalently, either individually or in combination with any other feature, in any configuration.

Another embodiment of the invention includes a method having any limitation described herein, explicitly or equivalently, either individually or in combination with any other limitation, in any order.

BRIEF DESCRIPTION OF THE DRAWINGS

Referring now to the drawings, which are meant to be exemplary and not limiting, and wherein like elements are numbered alike in the accompanying Figures.

DETAILED DESCRIPTION OF THE INVENTION

Figure 1:
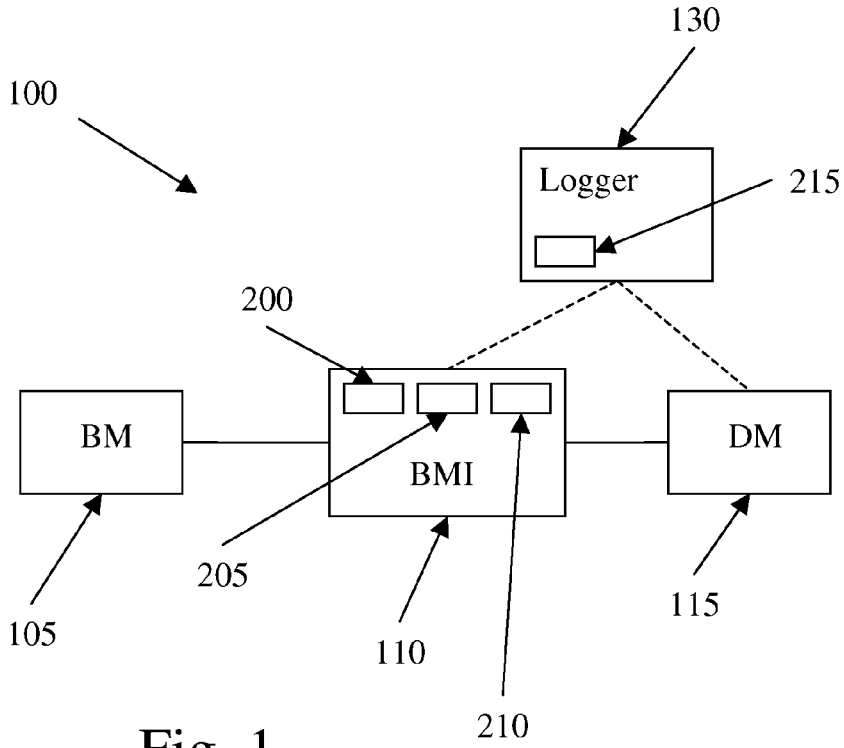
FIG. 1 depicts in block diagram schematic an example blasting control system in accordance with an embodiment of the invention.

An embodiment of the invention, as shown and described by the various figures and accompanying text, provides a blasting machine interface (BMI) serially disposed between a blasting machine (BM), which may be a commercially available apparatus, and a detonator module (DM) for controlling the communication between the BM and the DM. The DM includes a digitally lockable control circuit and a firing circuit (detonator) where the detonator can only be fired via a firing signal from the BM when the detonator is unlocked. That is, the BMI would allow or pass a firing current from the BM to the detonator only when the detonator is unlocked via a verification signal from the BMI that serves to verify a proper identification (ID) of the associated detonator. In an embodiment, the detonator is a diode protected seismic electric detonator (DiPED). It should be understood that there is no communication between the BM and the DM. The BM sends the firing pulse (required energy/voltage) to the DM via the BMI. There is no "communication" between the BMI or DM and the BM. Communications are between the BMI, or alternatively a logger, and DM only. Existing seismic practice calls for remote control of the blasting event where the command to initiate the firing pulse is sent wirelessly (from the dog house) to the BM.

In an embodiment, the control circuit is an ASIC (Application Specific Integrated Circuit), which is incorporated into the design of the DM, and which may also include a MOSFET (Metal Oxide Semiconductor Field Effect Transistor) or other similar circuitry capable of electronically switching the flow path of current to the detonator bridge wire after having been "unlocked" by use of the BMI, and a means of communicating, in both directions, between the detonator and the BMI.

In an embodiment, RS-485 communication protocols are used for sensing and controlling the "digitally locked" detonator, where the communication hardware path is polarity insensitive and capable of withstanding up to a maximum twenty milliamps (20 mA) current leakage between detonator leg/lead wires. Leakage current preventing digital communication between a typical programming system and a detonator is a common problem in electric and electronic detonator systems, which has been overcome with the development of the RS-485 serial communication protocol. As such, an embodiment using RS-485 communication protocols allows digital communication over relatively large distances and is tolerant of noise, leakage currents, and magnetic field interference. In an embodiment, the RS-485 communications protocol is used at the physical hardware level along with a communications encoding technique, such as Manchester Differential Encoding for example, used as the communication software layer.

Communication via RS-485 would be used to "lock" and "unlock" the detonator bridge wire firing circuit and allow the firing pulse (required voltage and current) to be passed from industry standard fire sets to the detonator via the BMI.

In an embodiment, the detonator would be "digitally locked" at the manufacturing facility such that the current flow path to the firing circuit, or bridge wire, would be interrupted until the detonator is unlocked. As used herein, reference to a digitally locked detonator means a digitally locked DM where the control circuit of the DM has been modified (locked) in such a manner as to prevent a firing signal from reaching the detonator (firing circuit) of the DM.

Embodiments of the invention include without limitation at least the following three configurations.

Configuration-1:

In an embodiment consistent with configuration-1, the DM has an electronic identification (ID) or is able to store data or be programmed in any way for purposes of identification, and would be responsive to a proprietary digital signal for activation and/or unlocking. On receipt of this digital signal the DMs would unlock, thereby enabling them to be fired upon receipt of a high voltage Capacitor Discharge (CD) pulse blasting signal being applied to the input pins of the DMs. If the enabling signal were removed, the DMs would return to a disabled state. In this configuration, security is achieved by two methods. First, only a proprietary BMI is capable of providing the enable signal. And second, the BMI requires a user-established password to turn on the DM and use it. A data logger would typically not be used with this configuration, but a test unit could be employed that would verify that the detonator of the DM was in good working order when a blast hole is loaded. If a test unit were to be employed, it could be made to perform as a data logger and enter a variety of data relative to a shot point for later retrieval by a computer, but there would not be a true tie back to the specific DM.

Configuration-2:

In an embodiment consistent with configuration-2, the DM is equipped with a unique ID. When connected to a logger or BMI, the ID is displayed on the respective machine, which enables the BM to verify from loading data that it is connected to the correct DM in the correct blast hole. As with configuration-1, a CD pulse fires the detonator of the DM once the BMI provides an enable signal that unlocks the DM. In this configuration, a logger/tester is used to obtain the ID when the blast hole is loaded. This configuration also provides for entry of data, such as date, time, operator, grid location, depth, GPS, for example, at the logger/tester that can be correlated with the DM in the associated blast hole. While security of configuration-2 is achieved in the same way as in configuration-1, a BM capable of arming the overall system including the BMI is needed, which itself is password protected. By displaying the ID, an operator has some assurance that the correct BM is connected to the correct DMs. The unique ID need not be preprogrammed into the DM, but instead may be generated when the detonator is connected to the "Logger" in the field. A unique detonator ID could be generated and stored in either or both the DM and BMI using the detonator's GPS location or shot point lat/long as an input to a random number generator algorithm.

Configuration-3:

In an embodiment consistent with configuration-3, the DM is also equipped with a unique ID, similar to configuration-2, but is also be capable of receiving and storing a user-supplied code. In an embodiment, this code is a 9-digit grid location, but it could also be a GPS location or any user-supplied code suitable for the purposes disclosed herein up to the design limitation of the particular DM. As in configuration-2, a logger for use with configuration-3 is configured to accept any desired correlating data, as discussed above, but would also be used to enter the user-supplied code into a memory of the DM. On connection of the DMs to the BMI, the ID would be displayed, but the operator is required to enter the user-supplied code previously set by the logger to enable/unlock the DM, which is then fired by a CD pulse. If all of the data entered into the logger is lost, a BMI can be connected to the logger and a new user-supplied code entered, which would then allow reconnection to a BM for firing. In this configuration, security is achieved by requiring a proprietary BMI, password protection on the BM, and a requirement that a user enter a user-supplied code for the specific blast hole defined by the logger.

In view of the foregoing, it will be appreciated that the DM and BMI in combination consists of hardware and software to permit a digital command to be sent from the BMI to the DM that will unlock the detonator causing completion of a conductive electrical path from the BM to the DM, thereby providing the BM with the ability to fire the detonator charge. In addition, the BMI is capable of querying the detonator for its unique serial ID number, and for a positive readout of an internal bridge wire continuity test, which can then be displayed on the BMI, thereby permitting operator verification of the wiring and charge before firing. In an embodiment, the detonator has separate internal hardware that requires an elevated minimum voltage level of approximately 200 VDC, for example, thus eliminating the need to maintain ELV (Extra Low Voltage) or intrinsic safety designs. In an embodiment, a passive sense resistor is used across the input of the detonator, such that an industry standard blasting ohm meter or blasting galvanometer can be used to verify the integrity of the wiring to the detonator. The physical communication hardware path between the BM and DM via the BMI is configured to support polarity insensitivity as well as dependable communication, at a reasonable communication rate when exposed to voltage leakage of 20 mAh (0.020 ampere-hours) between the lead wires.

Example specifications for a DM control circuit and a BMI, where the control circuit is configured to interface with an industrial BM (minimum of 2 joules of energy) through a BMI, are provided in Table-1 below. While embodiments of the invention are described in connection with specifications presented in Table-1, it will be appreciated that these specifications are for example purposes only, and are not restrictive or limiting in any way. That is, other specifications may be employed that are not presented in or are different from those presented in Table-1.

TABLE 1

| Electrical Specification: | | |
|---|---|---|
| 1. | Minimum ignition voltage (DC) if enabled | 200 VDC |
| 2. | Max. non-ignition voltage (DC) if disabled | 500 VDC |
| 3. | Bridge wire resistance (approx.) | 0.94 Ω |
| 4. | Maximum communication distance | 4,000 feet |
| 5. | Maximum commuication data rate | 100 kbit/sec (typical), 10 Mbit/sec (max). |
| 6. | ESD immunity (based on HBM) | Class 3B (>8000 volts), |
| 7. | Bridge wire gauge (approx.) | AWG 44 (.002") |
| 8. | Blasting Machine Interface power requirement | <=24 volt DC |

TABLE 1-continued

| | | |
|---|---|---|
| Mechanical Specification: | | |
| 1. Igniter PCB length (max) | 1.5 | inches |
| 2. Igniter PCB width (max) | 0.24 | inches |
| 3. Igniter PCB thickness (max) | 0.045<br>0.24 | inches w/out components,<br>inches populated. |
| 4. Blasting Machine Interface PCB length (max) | 5 | inches |
| 5. Blasting Machine Interface PCB width (max) | 7 | inches |
| 6. Blasting Machine Interface PCB thickness (max) | 0.66<br>2 | inches w/out components,<br>inches populated. |
| Environmental Specification: | | |
| 1. Igniter operating temperature | −55° C.-+125° C. | |
| 2. Igniter storage temperature | −55° C.-+150° C. | |
| 3. Blasting Mach. Interface operating temp. | −40° C.-+85° C. | |
| 4. Blasting Mach. Interface storage temp. | −55° C.-+150° C. | |
| 5. Ground resistance (leakage) | TBD | |
| 6. RoHS compliant components | Yes | |

(TBD, To Be Determined)

(The RoHS (Reduction of Hazardous Substances) Directive, EU Directive 2002/95/EG, is in effect as of Jul. 1, 2006, in Europe.)

(HBM, Human Body Model for electrostatic discharge)

Reference is now briefly made to FIG. 1, which depicts in block diagram schematic an example blasting control system 100 having a BM 105, a BMI 110, and a DM 115, in accordance with an embodiment of the invention. In an embodiment, BM 105 is a commercially available apparatus, such as "Boom Box" available from Seismic Source Co. of Ponca City, Okla., or "Shot Pro II™" available from Pelton Co., Inc., of Ponca City, Okla.

Figure 2:
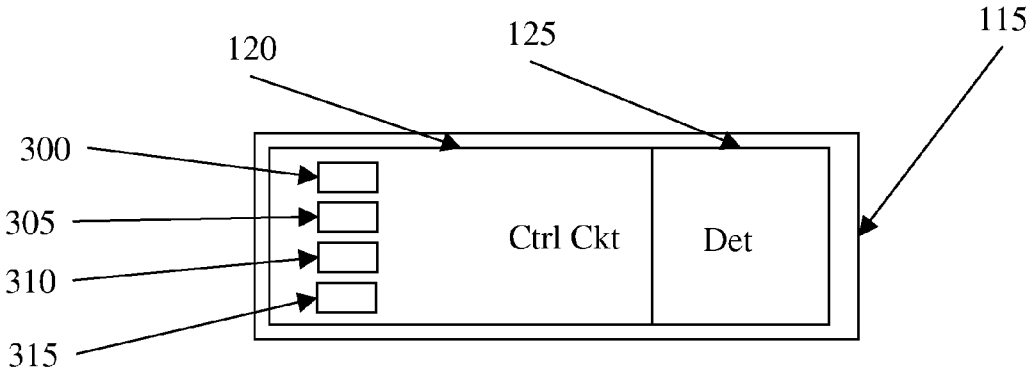
FIG. 2 depicts in block diagram schematic an example detonator module in accordance with an embodiment of the invention.

Reference is now briefly made to FIG. 2, which depicts in block diagram schematic DM 115 having a control circuit 120 and a detonator 125. In an embodiment, detonator 125 is a commercially available apparatus, such as "Electric Super™ Seismic" available from Dyno Nobel. In an embodiment, and consistent with the structure of the "Electric Super™ Seismic" incorporated herein by reference, the detonator 125 comprises an aluminum shell having a closed end and an open end, primary and secondary charge powder disposed within the shell, a firing bridge wire disposed in the primary charge powder, and signal leads connected to the bridge wire and extending through a sealing plug for connection to a firing device. However, and as discussed below, alternative embodiments include an arrangement where the control circuit 120 is integrated with the detonator 125 such that the DM 115 comprises a shell that encapsulates both 120 and 125, with signal leads extending through a sealing plug for connection to the BMI 110. As such, the control circuit 120 may be incorporated with the detonator 125 during manufacturing, or may be added as a separate component into existing detonator designs, such as ESS (Electric Super™ Seismic available from Dyno Nobel) or DiPED detonator designs for example.

In an embodiment, and with reference now to both FIGS. 1 and 2, the BMI 110 depicted in FIG. 1 includes an Input/Output device 200 (such as a keypad, touch screen, or any other suitable I/O device), a communication device 205 suitable for RS-485 serial communications, and a processor 210 for acting upon any I/O instructions or any instructions received from communication device 205. Processor 210 may be separate from communication device 205 or may be integrated therewith. As used herein, and in the context of processor functions, it will be understood by one skilled in the art that the term instructions means computer executable instructions.

In an embodiment, the control circuit 120 depicted in FIG. 2 includes a memory 300, a switch 305 (such as a MOSFET for example), a communication device 310 suitable for RS-485 serial communications, and a processor 315 for acting upon any instructions received from communication device 310, such as locking/unlocking switch 305 or reading the ID stored in memory 300.

In an alternative embodiment, as discussed above in connection with configurations-2 and 3, a data logger 130 having an input/output (I/O) device 215 is employed and connected to either or both of the BMI 110 and/or the DM 115. When connected to BMI 110, the I/O device 215 of logger 130 is used to obtain the ID from DM 115 when the blast hole is loaded, as discussed above in connection with configuration-2. Data entry (correlating data), such as date, time, operator, grid location, depth, GPS, for example, input into logger 130 can be correlated with the DM 115 in the associated blast hole. When used with the system consistent with configuration-3, logger 130 may not only be configured to accept any desired correlating data, as discussed above in connection with configuration-2, but would also be used to enter, via I/O device 215, a user-supplied code into a memory of the DM 115. On connection of the DMs (generally referred to by reference numeral 115, but recognized that a plurality of DMs would be employed in a plurality of blast holes) to the BMI 110, the ID of the associated DM 115 would be displayed at the BMI 110, however, the operator of the system would be required to enter the user-supplied code previously set by the logger to enable/unlock the associated DM 115, which could then be fired by a CD pulse, as discussed above. If all of the data entered into the logger 130 were to be lost, a BMI 110 could be connected to the logger 130 and a new user-supplied code entered, which would then allow reconnection of the DMs 115 to a BM 105 for firing.

Figure 3:
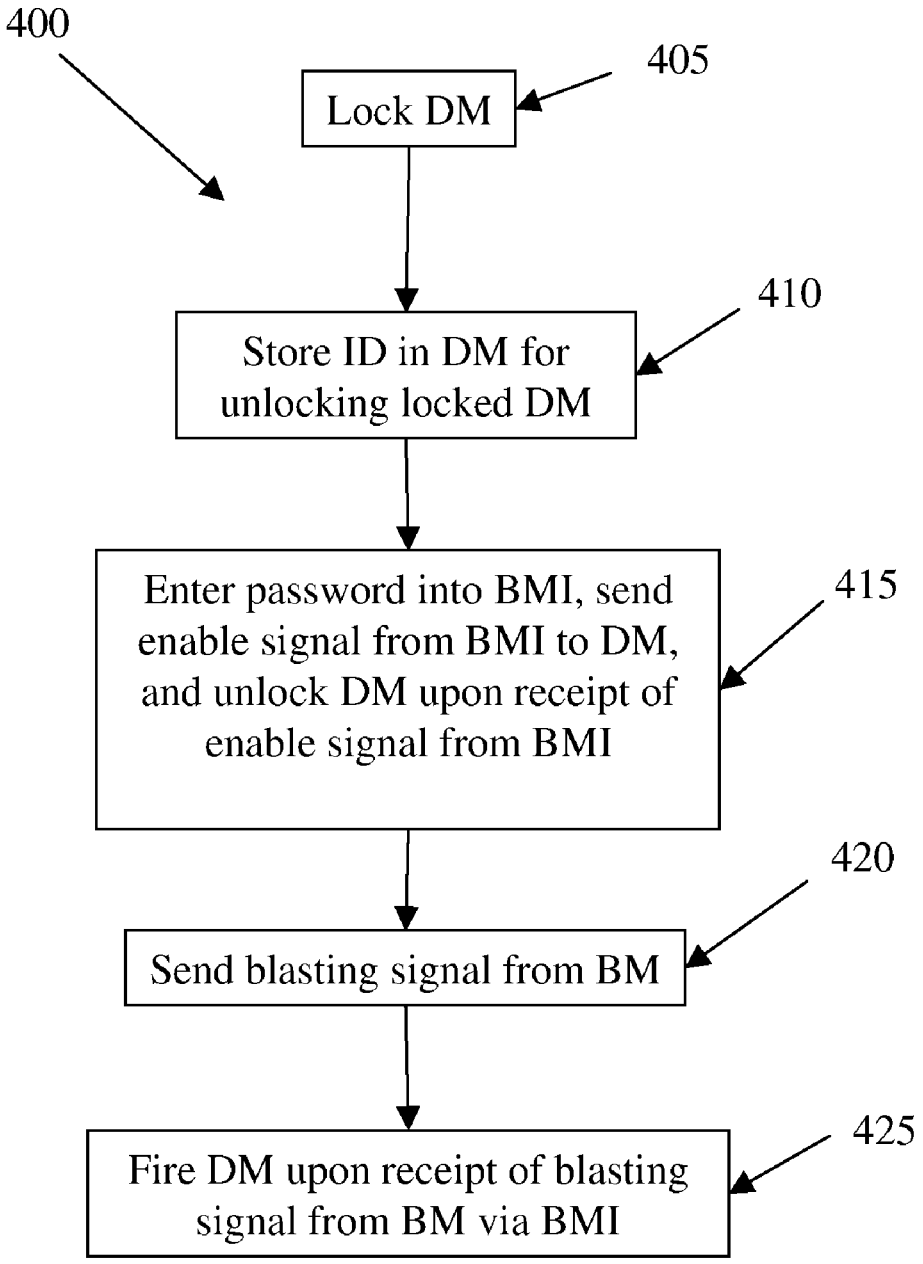
FIGS. 3-5 depict in flowchart form example and alternative methods for controlling the system of FIG. 1 in accordance with embodiments of the invention.
Figure 4:
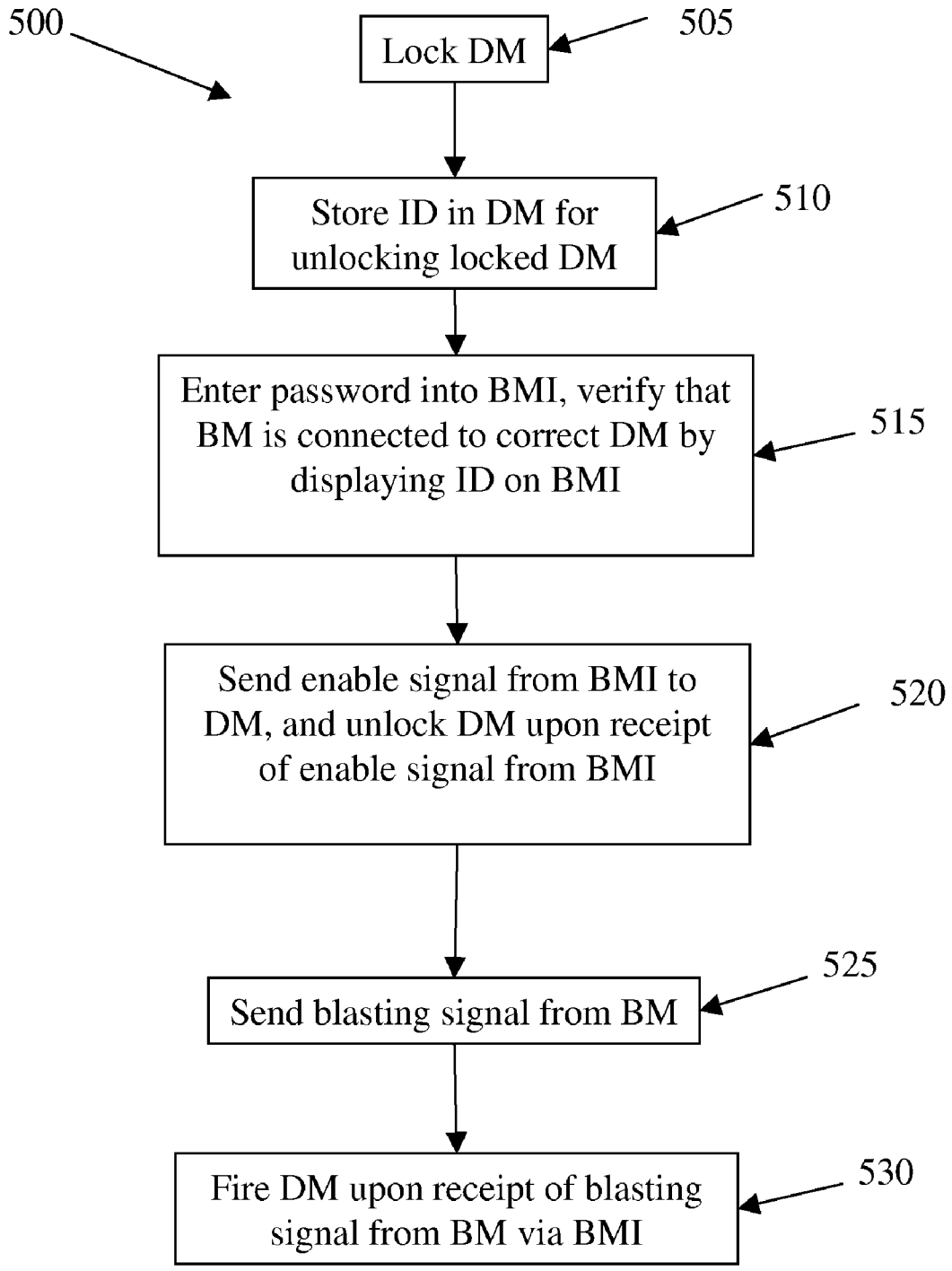
Figure 5:
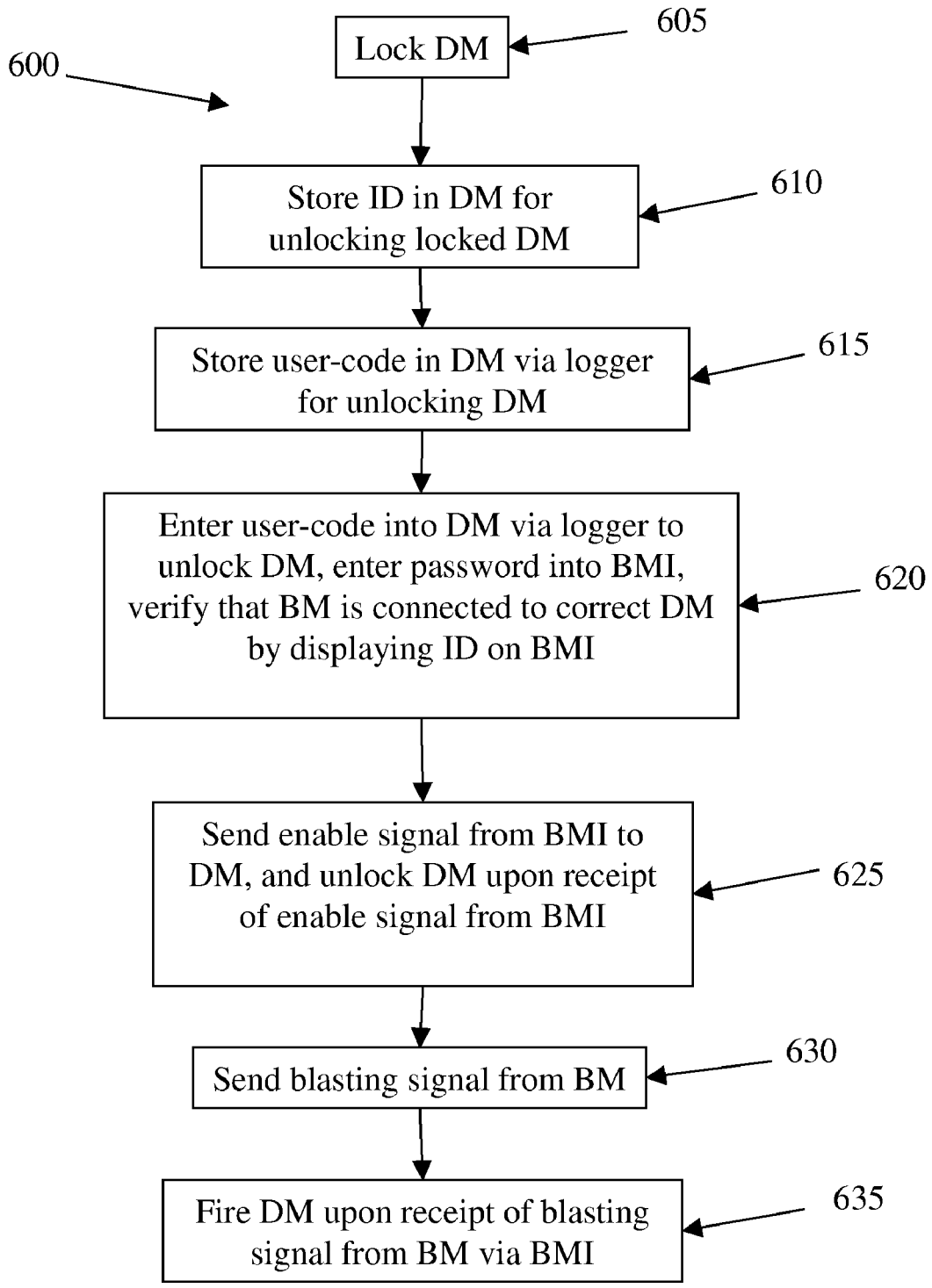

Operation of the blasting control system 100 is as discussed above and as generally outlined in the flowcharts of FIGS. 3-5, which depict example methods 400, 500 and 600, correlating to configurations 1, 2 and 3 discussed above, for controlling system 100.

Method 400 includes method blocks 405 (Lock DM), 410 (Store ID in DM for unlocking locked DM), 415 (Enter password into BMI, send enable signal from BMI to DM, and unlock DM upon receipt of enable signal from BMI), 420 (Send blasting signal from BM) and 425 (Fire DM upon receipt of blasting signal from BM via BMI) as illustrated in FIG. 3 and described above in connection with configuration-1.

Method 500 includes method blocks 505 (Lock DM), 510 (Store ID in DM for unlocking locked DM), 515 (Enter password into BMI, verify that BM is connected to correct DM by displaying ID on BMI), 520 (Send enable signal from BMI to DM, and unlock DM upon receipt of enable signal from BMI), 525 (Send blasting signal from BM) and 530 (Fire DM upon receipt of blasting signal from BM via BMI) as illustrated in FIG. 4 and described above in connection with configuration-2.

Method 600 includes method blocks 605 (Lock DM), 610 (Store ID in DM for unlocking locked DM), 615 (Store usercode in DM via logger for unlocking DM), 620 (Enter usercode into DM via logger to unlock DM, enter password into BMI, verify that BM is connected to correct DM by displaying ID on BMI), 625 (Send enable signal from BMI to DM, and unlock DM upon receipt of enable signal from BMI), 630 (Send blasting signal from BM) and 635 (Fire DM upon receipt of blasting signal from BM via BMI) as illustrated in FIG. 5 and described above in connection with configuration-3.

To perform the desired communication and control operations, processors 210, 315 are configured to be responsive to computer-executable code which when executed on the respective processor facilitates the desired communication and control operations as described and illustrated herein.

The hardware of the DM electronics (control circuit 120) includes a memory for storage of a unique, non-repeatable serial number, bi-directional communication from the BMI, enable/disable state of the detonator as directed by input to the BMI, igniter polarity insensitivity, secondary elevated threshold voltage circuitry.

Software design and coding for the DM includes a robust communication protocol, a configuration and control data set to include: igniter enable/disable, query the serial number, master igniter reset.

Hardware design of the BMI can either be embedded in an industry available BM or located externally between the BM and the igniter/detonator. The BMI will provide an industry standard asynchronous serial, SPI (synchronous serial), or USB communication connector for connection to the command/control equipment with an embedded visual alphanumeric display (that is, LCD, LED for example) to support operation at extended temperature range (such as to −20 C for example). Visual indicators include status LEDs supporting igniter lock/unlock and switches that include enable or disable control of the detonator.

Software design and coding of the BMI includes support of the detonator communication and control protocol, and support of the user interface (such as LED and switches to enable or disable the detonator for example).

In an embodiment, the igniter PCB (control circuit 120 of DM 115) is so dimensioned and configured as to fit into an industry standard encapsulation housing available from Dyno Nobel, which in an embodiment has a nominal inside diameter of 0.25 inches, that is, an inside diameter of 0.256 inches, and an outside diameter of 0.295 inches. However, it will be appreciated that the scope of the invention is not limited to a nominal inside diameter of 0.25, but is instead commensurate with the disclosure and purpose presented herein. In an embodiment, the blasting machine interface is configured for internal integration into an industry standard blasting machine, and in another embodiment is configured to operate as a "stand alone" device. The PCB configurations are made for high volume SMT (Surface Mount Technology) construction and automated final assembly.

An embodiment of the invention may be embodied in the form of computer-implemented processes and apparatuses for practicing those processes. Embodiments of the invention may also be embodied in the form of a computer program product having computer program code containing computer executable instructions embodied in tangible media, such as floppy diskettes, CD-ROMs, hard drives, USB (universal serial bus) drives, or any other computer readable storage medium, such as read-only memory (ROM), random access memory (RAM), erasable-programmable read only memory (EPROM), and electronically erasable programmable read only memory (EEPROM), for example, wherein, when the computer program code is loaded into and executed by a computer, the computer becomes an apparatus for practicing embodiments of the invention. Embodiments of the invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing embodiments of the invention. When implemented on a general-purpose microprocessor, the computer program code segments configure the microprocessor to create specific logic circuits. A technical effect of the executable instructions is to control the unlocking of a detonator for controlled detonation thereof.

As disclosed, some embodiments of the invention may include some of the following advantages: the reduction or elimination of unauthorized use of commercial electric detonators; and, a blasting system that overcomes present limitations on the number of detonators in a blast site as well as limits on communication distances between the BM and DMs.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A blasting control system for use with a blasting machine, the control system comprising:

a detonator module; and a blasting machine interface configured for serial communication between the blasting machine and the detonator module;

wherein the detonator module comprises a detonator, a unique electronic identification (ID), a switch configured to enable and disable activation of the detonator in response to a user's verification of the associated unique electronic ID, a communication device configured for communication with the blasting machine interface, and a processor responsive to computer executable instructions from the communication device;

wherein the blasting machine interface comprises an input/output (I/O) device, a communication device, and a processor responsive to the I/O device and the communication device;

wherein upon verification of the unique electronic ID of the detonator module via communication from a user via the blasting machine interface, a state of the switch associated with the detonator is placed in an unlocked mode so as to enable activation of the associated detonator upon a fire signal from the blasting machine via the blasting machine interface.

2. A method for controlling a blasting system, comprising:

providing a detonator module with a detonator in a locked state;

providing or storing a unique identification at and associated with the detonator, verification of the unique identification being operational for unlocking the detonator for controlled detonation;

entering a password into a blasting machine interface for providing operational control of the blasting machine interface;

sending an enable signal from the blasting machine interface to the detonator module, the enable signal containing verification information relating to the unique identification, and unlocking the detonator at the detonator module upon receipt of the enable signal; and sending a fire signal from a blasting machine to the detonator module via the blasting machine interface, and firing the detonator upon receipt of the firing signal.

3. A blasting control system of claim 1 comprising a first processor at the blasting machine interface and a second processor at the detonator, each of the first and second processors being separately responsive to computer-executable code which when executed on the respective processor facilitates the method of claim 2.

4. The blasting control system of claim 1, wherein:

the switch comprises electronic switching circuitry;

the detonator module comprises a digitally lockable control circuit configured to be locked and unlocked via the switch; and the digitally lockable control circuit is configured to prevent a firing signal when present from reaching the detonator when the digitally lockable control circuit is locked.

5. The blasting control system of claim 4, wherein the communication device is configured to receive a digital signal which when received results in the switch unlocking the digitally lockable control circuit.

6. The blasting control system of claim 1, wherein the blasting machine is configured for sending a firing pulse to the detonator module via the blasting machine interface absent exchange of communication protocols between the blasting machine and the blasting machine interface, and the blasting machine interface is configured for communications with the detonator module.

7. The method of claim 2, wherein the sending an enable signal from the blasting machine interface to the detonator module comprises sending a digital command signal.

8. The method of claim 2, further comprising:

subsequent to entering a password into the blasting machine interface, and prior to sending an enable signal from the blasting machine interface, verifying that the blasting machine is connected to a correct detonator module by displaying the unique identification of the detonator at the blasting machine interface.

9. The method of claim 8, further comprising:

prior to entering a password into the blasting machine interface:

entering or storing a user-code into a memory of the detonator module via a data logger, re-entry of the user-code by an operator being operational for unlocking the detonator for controlled detonation; and re-entering the user-code previously set by the data logger to facilitate unlocking of the detonator.

10. The method of claim 9, wherein the entering or storing a user-code into the memory of a detonator module via a data logger comprises entering or storing a grid location of an associated detonator module.

11. The method of claim 2, further comprising:

querying the detonator module, via the blasting machine interface, for the unique identification of the detonator and for a positive continuity test readout of the detonator, and displaying results of the query and the continuity test readout on the blasting machine interface.

* * * * *